US005967744A

United States Patent [19]

Danner

[11] Patent Number: 5,967,744

[45] Date of Patent: Oct. 19, 1999

[54] CENTRIFUGAL PUMP HAVING ANTI-CLOGGING BACKFLOW PREVENTION GATE

[76] Inventor: Michael Danner, 21 N. Road, Stony Brook, N.Y. 11790

[21] Appl. No.: 09/057,200

[22] Filed: Apr. 8, 1998

[51] Int. Cl.[6] ..... F01B 19/02

[52] U.S. Cl. ..... 415/146; 415/204; 415/206; 415/911

[58] Field of Search ..... 415/146, 204, 415/206, 910, 911; 137/855

[56] References Cited

U.S. PATENT DOCUMENTS 5,131,432 7/1992 Santarossa et al. ..... 137/855
5,586,862 12/1996 Danner ..... 415/146

FOREIGN PATENT DOCUMENTS 1049066 4/1902 France ..... 415/146
1113729 4/1956 France ..... 415/146

*Primary Examiner*—F. Daniel Lopez
*Assistant Examiner*—Ninh Nguyen
*Attorney, Agent, or Firm*—Galgano & Burke

[57] ABSTRACT

A centrifugal pump, includes a pump volute having a substantially axial inlet port and a substantially radial outlet port and is substantially symmetrical about the axis of the outlet port, with the outlet port being flanked by a first and second side wall, an impeller rotably mounted inside the pump volute, a drive motor coupled to the impeller for imparting rotational movement to the impeller, and a gate mounted between the impeller and the outlet port. The gate is in the form of a resilient flap having a fixed end and a free end. The flap free end is movable between a first operating position where the free end is biased against one of the first and second walls during operation of the pump and a second non-operating position in which the gate is disposed in a normal unbiased position spaced between the first and second walls when the pump is not in operation.

11 Claims, 6 Drawing Sheets

CENTRIFUGAL PUMP HAVING ANTI-CLOGGING BACKFLOW PREVENTION GATE

BACKGROUND OF THE INVENTION

1. Field of the Invention

The present invention relates to centrifugal pumps. More particularly, the invention relates to a centrifugal pump having a "movable" gate to prevent fluid backflow which is not susceptible to clogging.

2. State of the Art

Centrifugal pumps utilize an impeller housed in a volute. Fluid enters the volute either axially or tangentially relative to the impeller and exits either axially or tangentially depending on the direction of impeller rotation. Centrifugal pumps may be driven by an AC motor or a DC motor. In either case, the pump impeller may be magnetically coupled to the rotor of the motor so that the workings of the motor can be hermetically sealed and isolated from the fluids passing through the pump. In the case of an AC motor driven pump, the impeller may turn in either of two directions depending on the phase angle of the AC power at the moment the motor is started. In order to provide predictable operation in an AC motor driven pump, the pump volute and impeller are specially designed so that the inlet and outlet of the pump are the same regardless of the rotational direction of the impeller.

Prior art FIGS. 1 and 2 illustrate a typical AC motor driven volute pump 10. The pump 10 includes an AC motor 12, a pump volute or housing 14 and an impeller shaft 16 which is coupled to an impeller hub 18 having a plurality of radial vanes or fins 20. As seen in FIG. 2, The pump volute or casing 14 is symmetrical about a vertical axis A—A with an axial inlet port 22 and a radial outlet port 24. Below a horizontal axis B—B the volute 14 is substantially cylindrical in shape, but above the horizontal axis B—B the volute 14 tapers with substantially tangential side walls 21, 23 to the radial outlet port 24. The impeller hub 18 is arranged axially with the inlet port 22. The impeller hub 18 has a smaller diameter than the inlet port 22 so that fluid entering the inlet port 22 is free to flow around the impeller hub and into the spaces between the vanes 20. Regardless of the direction of rotation of the impeller hub 18 and vanes 20, the vanes will create a centripetal force resulting in a low pressure condition at the impeller hub 18. This low pressure condition will draw fluid into the volute 14 via the inlet port 22. The fluid will enter the spaces between the vanes 20 whereupon it will be driven radially outward from the hub 18 in either a clockwise or counterclockwise flow, and tangentially along either side wall 21 or 23, depending on the direction of the flow, to the outlet port 24. Since the outlet port 24 and the side walls 21, 23 are arranged symmetrically about the vertical axis A—A, the radially outward driven fluid will ultimately exit the volute 14 through the outlet port 24 regardless of the direction of impeller rotation. Although this design of the volute and the impeller provides for a predictable direction of fluid flow regardless of the direction of rotation of the impeller, it does have some significant disadvantages.

In virtually every pumping operation, the exiting fluid is subject to back pressure. Since the outlet port 24 in the pump 10 is arranged symmetrically relative to the impeller, fluid under back pressure is free to re-enter the volute 14 and be recirculated by the impeller. This is illustrated in FIG. 2 by the arrows which point down from the outlet port 24. As those skilled in the art will appreciate, the problem of recirculating back flow is endemic to AC motor driven pumps using symmetrical volutes. In DC motor driven pumps, as mentioned above, the outlet port can be arranged tangentially to the impeller in an asymmetrical volute so that backflow is virtually eliminated. The problem of backflow recirculation in AC motor driven pumps decreases their efficiency since the outlet volume and pressure decreases when fluid is being recirculated.

U.S. Pat. No. 5,586,862 (the subject matter which is incorporated herein by reference hereto) overcomes the problem of backflow recirculation by providing for a pivotal gate which blocks the passage of fluid backflow.

Even with the improved system disclosed by U.S. Pat. No. 5,586,862, problems can arise. For instance, fluid flow through the outlet port can be restricted by as much as fifty percent (50%) of maximal flow due to clogging of the pivot axle and support of the pivotal gate. In particular, fluids pumped through centrifugal pumps comprise debris, particulate detrius, plant matter, organic slime, fish waste, etc. and such matter can clog the pivot axle and support thereby inhibiting if not stopping the pivot arm or gate from pivoting. In addition, as movement of the pivot arm and the fluid flow are restricted, when the pump is energized, the impeller may begin to run in the opposite direction.

SUMMARY OF THE INVENTION

It is therefore an object of the invention to provide a centrifugal pump which minimizes the problem of backflow recirculation.

It is another object of the invention to provide a centrifugal pump having a movable gate designed to minimize its susceptibility to clogging.

It is still a further object of the invention to provide such a centrifugal pump which is of simple design and is economical to manufacture.

Certain of the foregoing and related objects are readily attained in a centrifugal pump which includes a pump volute having a substantially axial inlet port and a substantially radial outlet port and being substantially symmetrical about the axis of the outlet port, with the outlet port being flanked by a first and second side wall. The pump also includes an impeller rotably mounted inside the pump volute, a drive motor coupled to the impeller for imparting rotational movement to the impeller and gate means mounted between the impeller and the outlet port. The gate means comprises a resilient flap having a fixed end and a free end. The flap free end is movable between a first operating position where the free end is biased against one of the first and second walls during operation of the pump and a second non-operating position in which the gate is disposed in a normal unbiased position spaced between the first and second walls when the pump is not in operation.

Preferably, the gate means includes a gate support and fixed end is attached to the gate support. Most advantageously, the gate support is generally C-shaped and the fixed end of the flap has an enlarged head received in the C-shaped gate support. The flap is desirably made of a member selected from the group consisting of rubber, synthetic rubber, synthetical plastic and a combination thereof. Most desirably, the flap has a Shore A hardness of between 45 and 65. In a preferred embodiment, the impeller has an axis of rotation which is substantially coaxial with the inlet port. The impeller preferably comprises an impeller hub and a plurality of vanes extending outward from said hub, with the hub having a diameter smaller than the diameter of the inlet port. Most advantageously, the volute is asymmetrical about an axis perpendicular to the axis of said outlet port. Most desirably, a portion of the volute on one side of said axis perpendicular to the axis of said outlet port is substantially cylindrical and the first and second side walls are substantially planar. The first and second side walls are preferably not parallel to each other.

According to a preferred embodiment of the invention, a stationary baffle is located between the gate and the impeller to further streamline and direct the flow of fluid.

BRIEF DESCRIPTION OF THE DRAWINGS

These and other objects and advantages of the present invention will become apparent from the following description of the accompanying drawings which disclose several embodiments of the present invention. It is to be understood that the drawings are to be used for the purpose of illustration only and not as a definition of the invention.

In the drawings, wherein similar reference numerals denote similar elements throughout the several views.

DETAILED DESCRIPTION OF THE PREFERRED EMBODIMENTS

Figure 1:
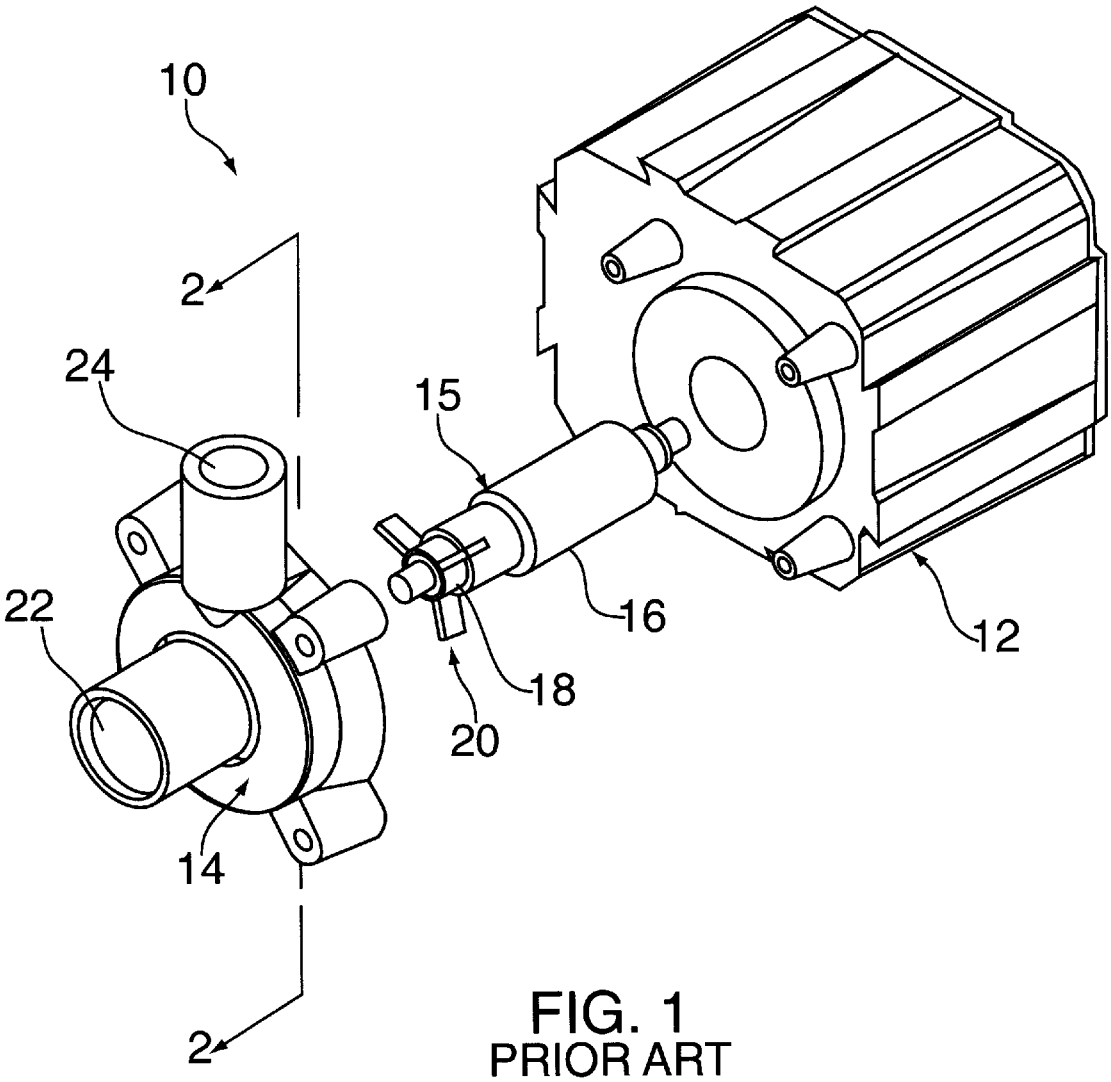
FIG. 1 PRIOR ART
FIG. 1 is an exploded perspective view of a prior art centrifugal pump.
Figure 2:
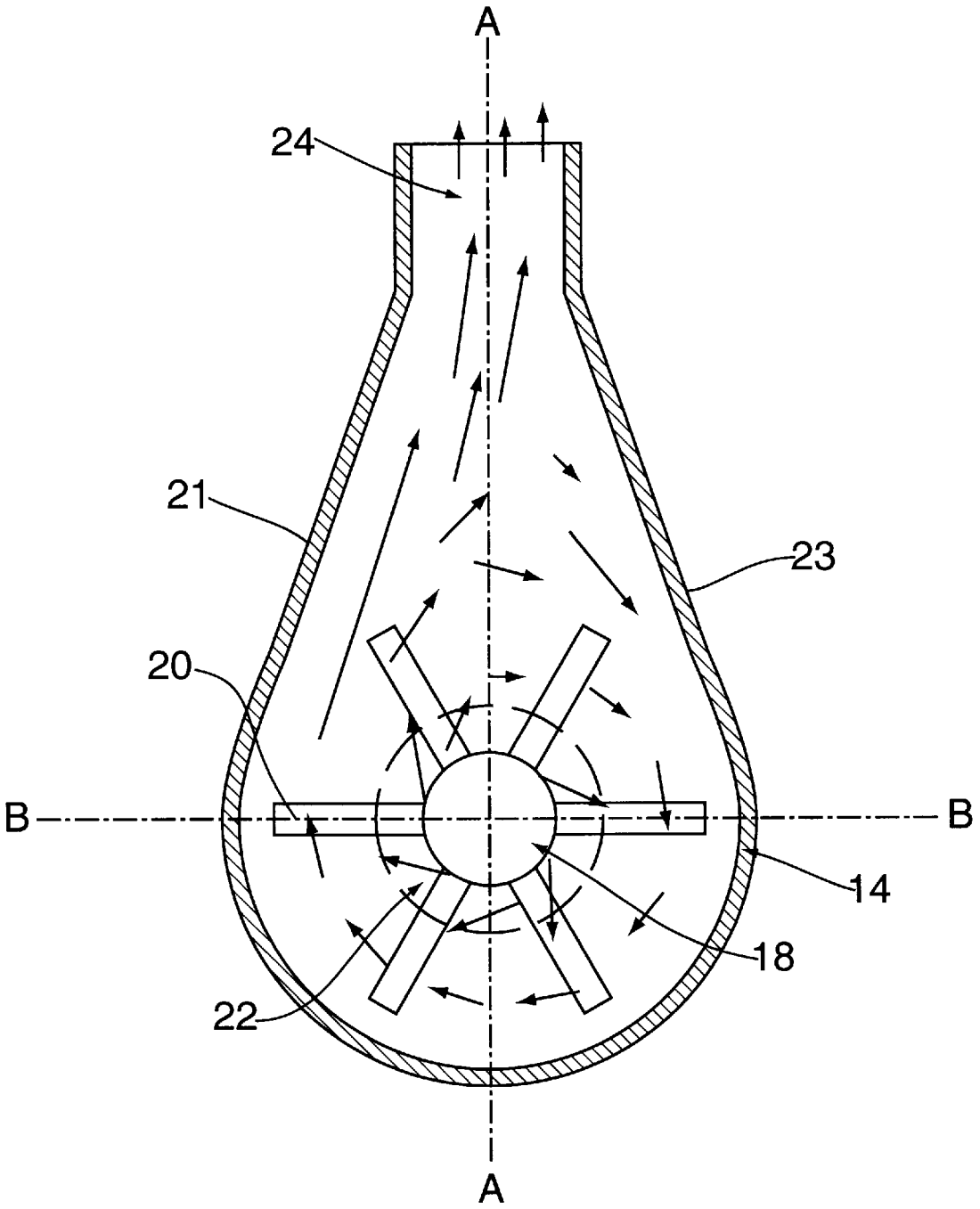
FIG. 2 PRIOR ART
FIG. 2 is a cross-sectional view of the interior of the prior art pump volute taken along line 2—2 in FIG. 1.
Figure 3:
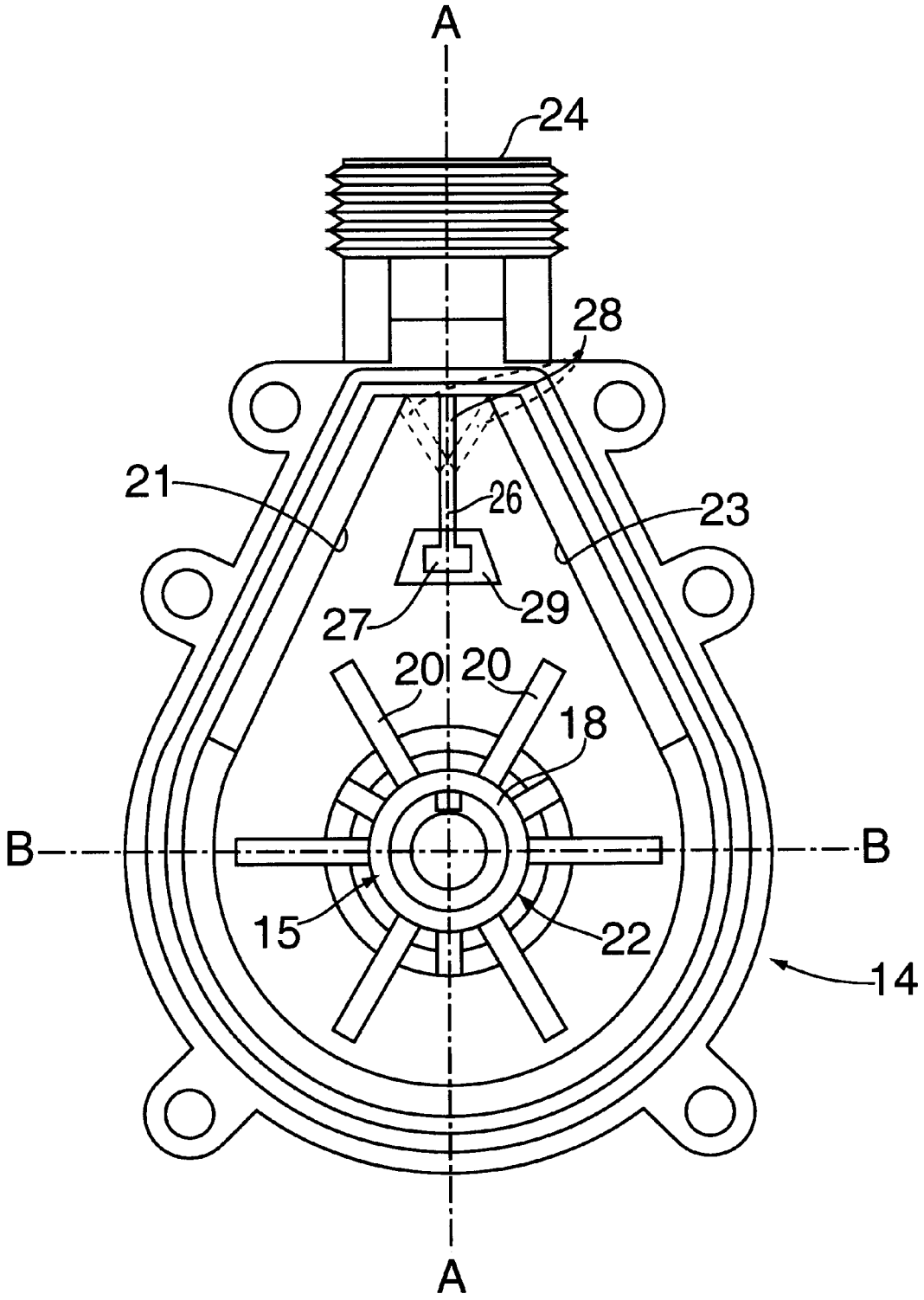
FIG. 3 is a cross-sectional view of the pump according to the present invention, showing the gate at rest when the pump is not in operation and, in phantom line, two alternate positions during pump operation.

Referring now to FIGS. 1–3, a volute pump according to the present invention incorporates many of the components of the prior art centrifugal pump 10 shown in FIG. 1, including, an AC motor 12, a pump volute or casing 14, and an impeller 15 having impeller shaft 16 which is coupled to an impeller hub 18 having a plurality of radial vanes or fins 20. The pump volute 14 is symmetrical about a vertical axis A—A with an axial inlet port 22 and a radial outlet port 24. Below a horizontal axis B—B (see FIG. 2), the volute 14 is substantially cylindrical in shape, but above the horizontal axis B—B, the volute tapers with substantially tangential side walls 21, 23 to the radial outlet port 24. The impeller hub 18 is arranged axially with the inlet port 22 and has a smaller diameter than the inlet port 22 so that fluid entering the inlet port 22 is free to flow around the impeller hub and into the spaces between the vanes 20. Regardless of the direction of rotation of the impeller hub 18 and vanes 20, the vanes will create a centripetal force resulting in a low pressure condition at the impeller hub 18. This low pressure condition will draw fluid into the volute chamber via the inlet port 22. The fluid will enter the spaces between the vanes 20 whereupon it will be driven radially outward from the hub 18 in either a clockwise or counterclockwise flow, and tangentially along either side wall 21 or 23, depending on the direction of flow, to the outlet port 24. Since the outlet port 23 and the side walls 21, 23 are arranged symmetrically about the vertical axis A—A the radially outward driven fluid will ultimately exit the volute chamber through the outlet port 24 regardless of the direction of impeller rotation.

According to the present invention, as shown in FIG. 3, a flexible, resilient gate 26 is designed inside the volute 34 such that it normally lies substantially on the vertical axis A—A of symmetry of the volute and is disposed between the impeller hub 18 and outlet port 24. Gate 26 has a lower end 27 having an enlarged head which is fixedly received in a generally C-shaped gate support 29 by means of a friction fit, adhesive male-female mechanical interlock or the like. Gate 26 is in the form of a flap and its lower end 27 effectively serves as a living or live "hinge" to allow its upper freeend 28 to flex or "pivot" from its normal position as shown in FIG. 3 to one of two alternate biased positions as shown in phantom line FIG. 3 (the purpose of which will be described in greater detail hereinafter).

Figure 4:
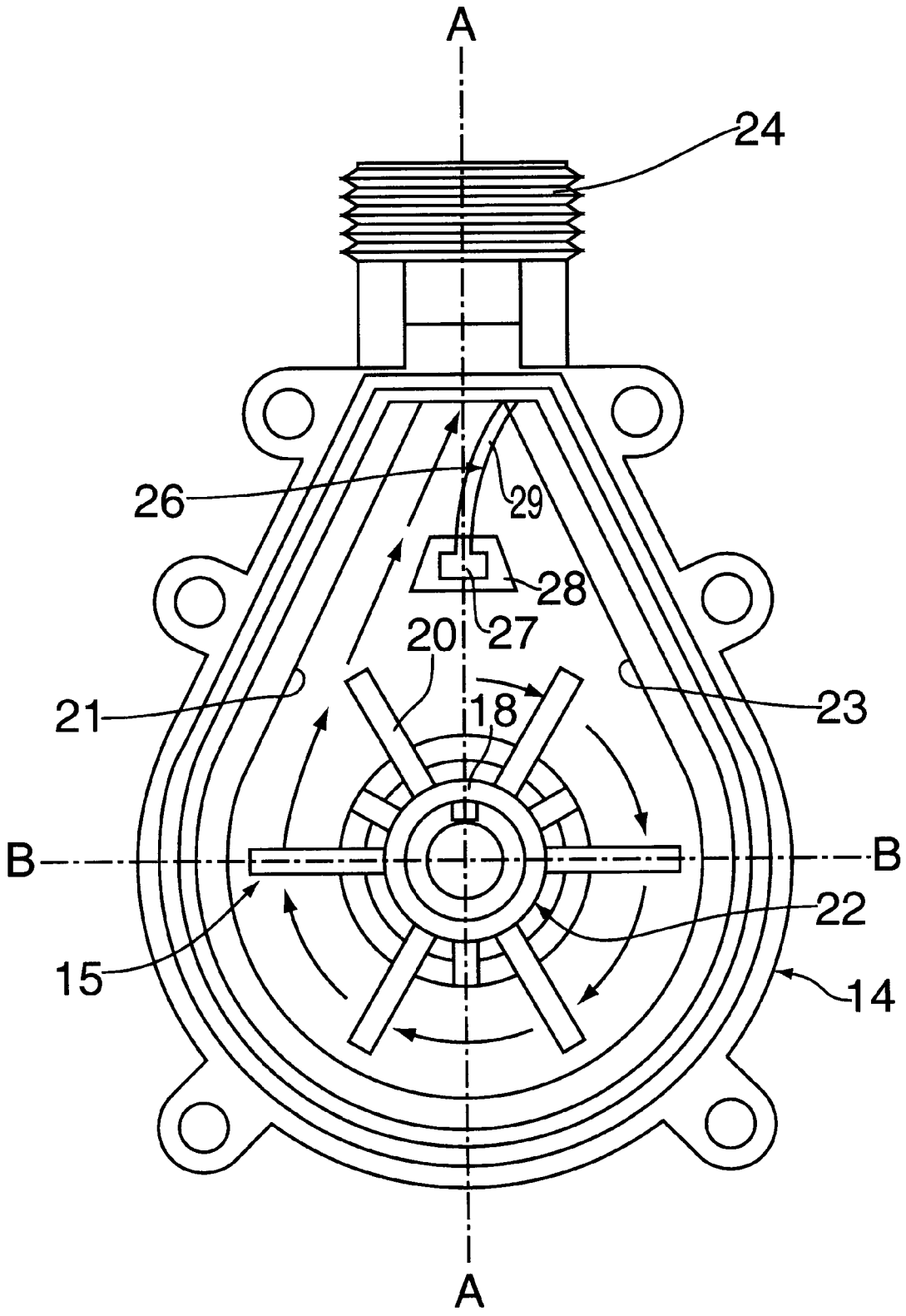
FIG. 4 is a cross-sectional view similar to that of FIG. 3, but showing the position of the gate during pump operation.

As shown in FIG. 4, during pump operation, the impeller 18 rotates either in a clockwise or counterclockwise direction and fluid is forced radially outward against one of tangential side walls 21, 23. In FIG.4 a clockwise rotation is specifically illustrated. As a result, the fluid flowing from the impeller 15 to the outlet port 24 is under pressure which causes the gate 26 to flex such that its free end 28 rests against or abuts the stationary side wall 23 of the casing 14 and it blocks fluid backflow from outlet port 24. Since the gate 26 is "hinged" above the axis of symmetry of the volute, it is free to pivot to one or the other sidewall depending on the direction of rotation of the impeller 15. Specifically, gate 26 is free to flex (in effect "pivot" to either biased position (against either sidewalk 21 or 23) in response to the pressure from the fluid flow inside the volute 14 and the direction of impeller 15.

Figure 5:
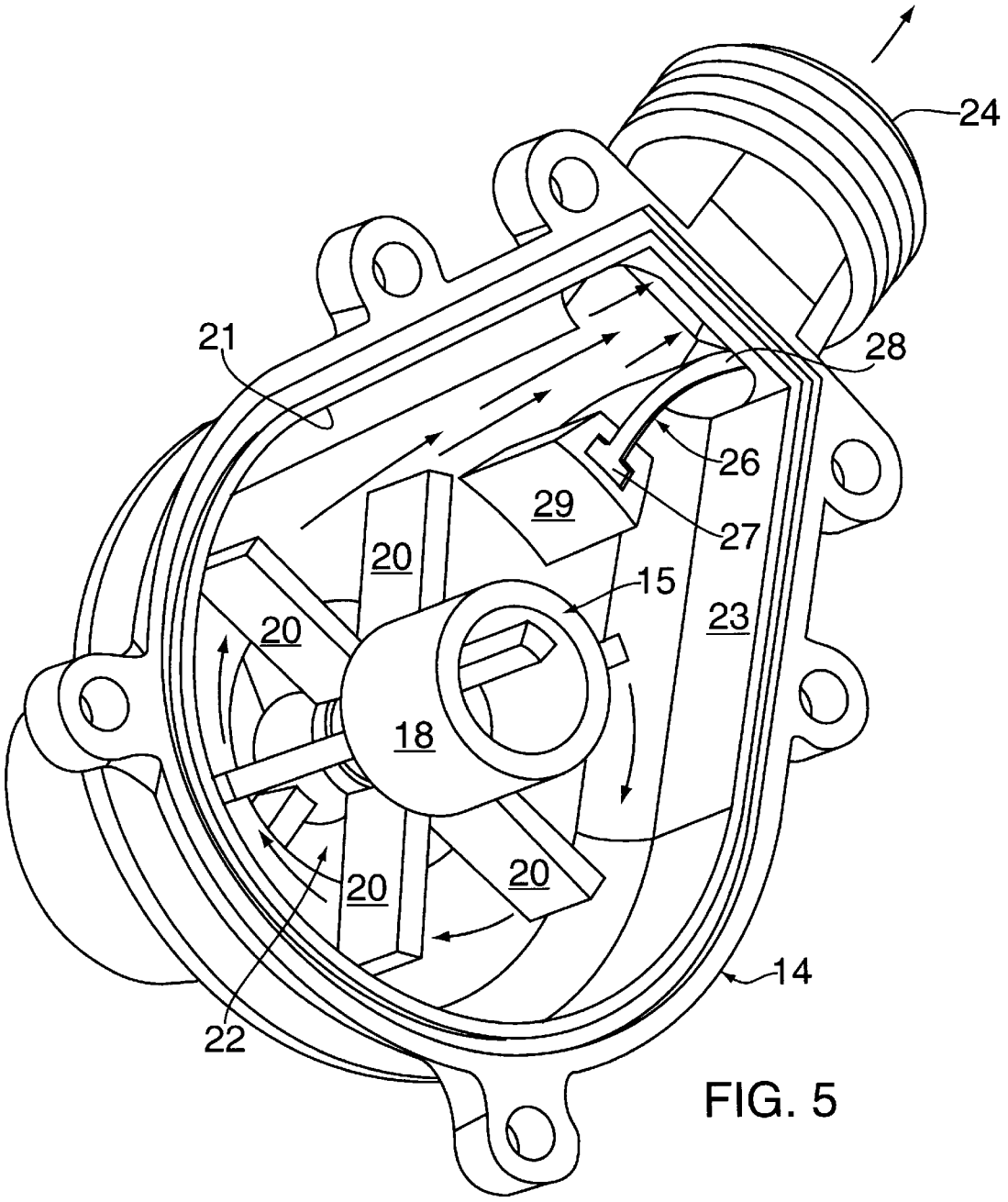
FIG. 5 is a perspective view of the pump shown in FIG. 3 with its front cover removed.

From the foregoing, those skilled in the art will appreciate that when the impeller 15 rotates in a clockwise direction as shown in FIG. 5, the flow of fluid indicated by the arrows inside the volute 14 will bias gate 26 to assume its flexed position. Comparing FIGS. 2 and 5, it will further be appreciated that this position of the gate 26 will effectively block backflow recirculation and thereby increase the volume and pressure output of the centrifugal pump 10.

It will also be appreciated that when the impeller 18 rotates in the direction opposite to that shown in FIG. 5, gate 26 will assume a position opposite to that shown in FIG. 5, (i.e., its free end and 28 will abut sidewall 21) and effectively block backflow recirculation as well.

Figure 6:
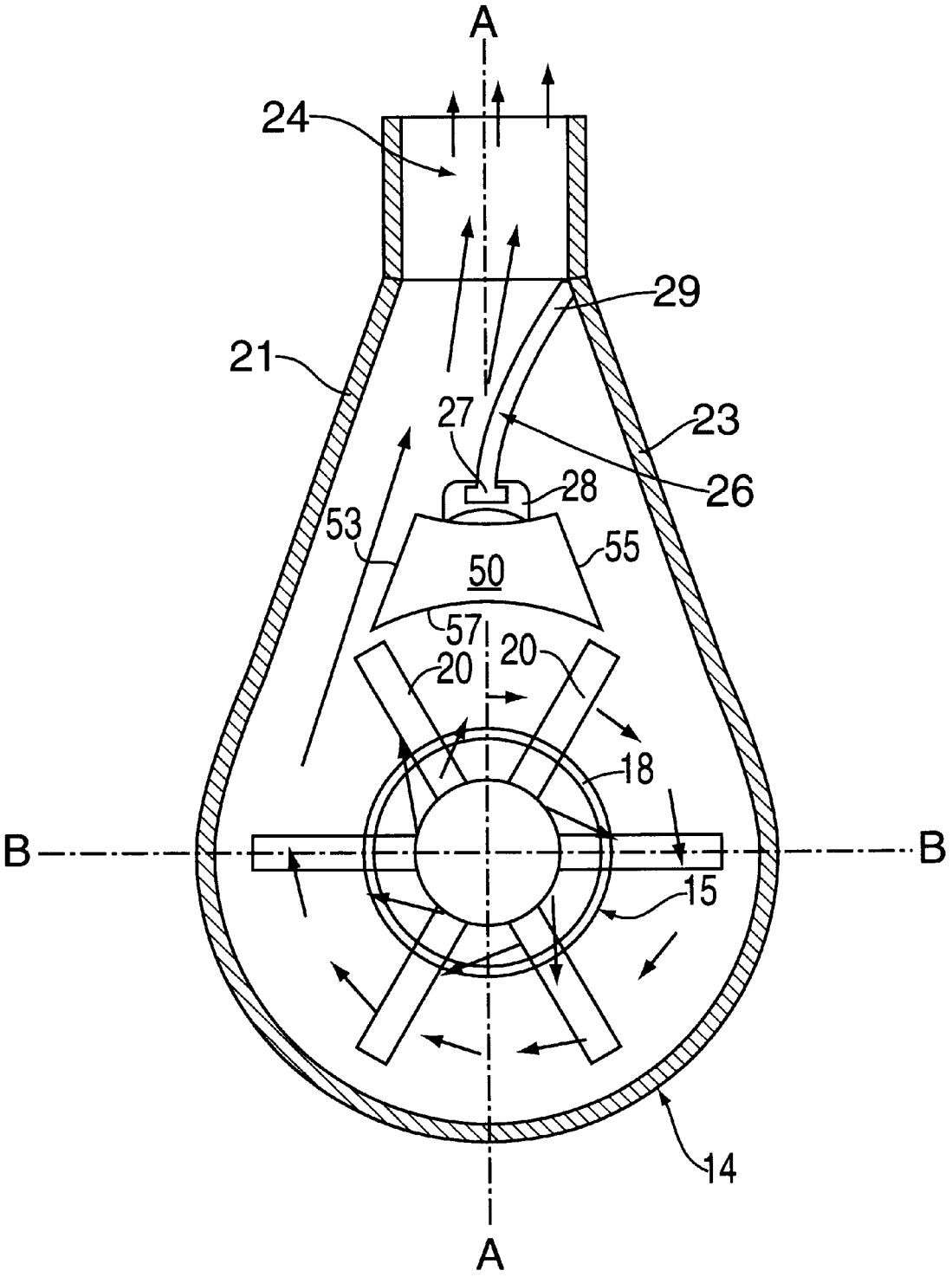
FIG. 6 is a cross-sectional view of a second embodiment of a pump according to the present invention.

FIG. 6 shows a second embodiment of the present invention in which a stationary baffle 50 is mounted inside the volute 14 between the gate support 28 and the impeller vanes 20. Baffle 50 has two lateral end walls 53, 55 so as to block fluid backflow from the outlet port 24. The baffle 50 has a lower concave surface 57 which has a radius of curvature slightly larger than the radius of the impeller 15. The baffle 50 is symmetrically aligned with the axis A—A and serves to further direct and streamline the flow of fluid inside the volute 14.

Preferably, gate 26 is made of rubber, a synthetic rubber and/or plastic material to allow its lower enlarged end 27 to act as a live hinge and allow its free end 29 to flex as described above. Preferably, gate 26 comprises TPE thermoplastic rubber sold under the trademark Santopreme No. 111 sold by Advanced Elastomer Systems, 388 South Main Street, Akron, Ohio 44311. Most desirably, the gate has a Shore hardness A of between 45 and 65. Those skilled in the art will appreciate that the flexure and hardness of the cantilever gate 26 can be modified depending upon the pressures employed in the volute 14.

As can be appreciated from the foregoing, the resilient cantilever gate 26 is not subject to clogging since it has a live hinge and does not have a pivot axle which can become clogged. As a result, the centrifugal pump of the present invention will operate more reliably over long periods of use.

Accordingly, while only several embodiments of the present invention have been shown and described, it is to be understood that many changes and modifications may be made thereunto without departing from the spirit and scope of the invention as disclosed herein.

What is claimed is:

1. A centrifugal pump, comprising:

a) a pump volute having a substantially axial inlet port and a substantially radial outlet port and being substantially symmetrical about the axis of said outlet port, said outlet port being flanked by a first and second side wall;

b) an impeller rotably mounted inside said pump volute;

c) a drive motor coupled to said impeller for imparting rotational movement to said impeller;

d) gate means mounted between said impeller and said outlet port, said gate means comprising a resilient flap having a fixed end and a free end, said flap free end being movable between a first operating position where said free end is biased against one of said first and second walls during operation of the pump and a second non-operating position in which said gate is disposed in a normal unbiased position spaced between said first and second walls when said pump is not in operation.

2. A pump according to claim 1, wherein said gates means includes a gate support and wherein said fixed end is attached to said gate support.

3. A pump according to claim 2, wherein said gate support is generally C-shaped and said fixed end of said flap has an enlarged head received in said C-shaped gate support.

4. A pump according to claim 1, wherein said flap is made of a member selected from the group consisting of rubber, synthetic rubber, synthetical plastic and a combination thereof.

5. A pump according to claim 4, wherein said flap has a Shore A hardness of between 45 and 65.

6. A pump according to claim 1, wherein said impeller has an axis of rotation which is substantially coaxial with said inlet port.

7. A pump according to claim 6, wherein said impeller comprises an impeller hub and a plurality of vanes extending outward from said hub, said hub having a diameter smaller than the diameter of said inlet port.

8. A pump according to claim 1, wherein said volute is asymmetrical about an axis perpendicular to said axis of said outlet port.

9. A pump according to claim 8, wherein a portion of said volute on one side of said axis perpendicular to said axis of said outlet port is substantially cylindrical and said first and second side walls are substantially planar.

10. A pump according to claim 8, wherein said first and second side walls are not parallel to each other.

11. A pump according to claim 1, additionally including a baffle disposed between said gate means and said impeller.

* * * * *